US010984701B2

(12) United States Patent
Huang et al.

(10) Patent No.: US 10,984,701 B2
(45) Date of Patent: Apr. 20, 2021

(54) SOURCE DRIVER

(71) Applicant: Raydium Semiconductor Corporation, Hsinchu (TW)

(72) Inventors: Chih-Chuan Huang, Zhubei (TW); Yu-Chun Lin, Kinmen County (TW); Ching Chuan Chiu, Changhua County (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 1 day.

(21) Appl. No.: 16/446,791

(22) Filed: Jun. 20, 2019

(65) Prior Publication Data

US 2020/0013328 A1 Jan. 9, 2020

(30) Foreign Application Priority Data

Jul. 3, 2018 (TW) ..... 107123002

(51) Int. Cl.
*G09G 3/20* (2006.01)

(52) U.S. Cl.
CPC ... *G09G 3/2092* (2013.01); *G09G 2310/0297* (2013.01); *G09G 2310/08* (2013.01)

(58) Field of Classification Search
CPC ..... G09G 3/20; G09G 3/2092; G09G 3/3685; G09G 2310/0278; G09G 2310/0286; G09G 2310/0297; G09G 2310/08; G09G 2320/0223
See application file for complete search history.

(56) References Cited

U.S. PATENT DOCUMENTS 8,378,999 B2 * 2/2013 Fukuo ..... G09G 3/3688 345/204
2007/0152947 A1 * 7/2007 Tanaka ..... G09G 5/001 345/100

* cited by examiner

*Primary Examiner* — Mihir K Rayan

(57) ABSTRACT

A source driver includes a phase generator, a control circuit, and an output circuit. The phase generator is configured to generate a plurality of output clock signals according to an input clock signal, in which the phases of the output clock signals are different from each other. The control circuit is configured to sequentially generate a plurality of control signals according to the output clock signals and a latch signal. The output circuit is configured to sequentially output a plurality of data voltages separately according to the control signals.

16 Claims, 9 Drawing Sheets

SOURCE DRIVER

BACKGROUND

Technical Field

The present disclosure relates to an electronic device. Specifically, the present disclosure relates to a source driver.

Related Art

With the development of the science and technology, display devices have been widely applied to people's lives.

A typical display device can include a gate drive circuit and a source drive circuit. The gate drive circuit is configured to supply gate signals to an active region so as to enable switches of pixel circuits in the active region to be turned on. The source drive circuit is configured to supply data voltages to the pixel circuits, of which the switches are turned on, in the active region so as to enable the pixel circuits in the active region to display corresponding to voltages of the data voltages.

However, due to the transmission delays of gate signals, if a plurality of data voltages are simultaneously supplied to the pixel circuits in the active region, some of the pixel circuits are undercharged so as to affect the display quality.

SUMMARY

An implementation manner of the present disclosure relates to a source driver. According to an embodiment of the present disclosure, the source driver includes a phase generator, a control circuit, and an output circuit. The control circuit is electrically connected with the phase generator. The phase generator is configured to generate a plurality of output clock signals according to an input clock signal, in which the phases of the output clock signals are different from each other. The control circuit is configured to sequentially generate a plurality of control signals according to the output clock signals and a latch signal. The output circuit is electrically connected with the control circuit. The output circuit is configured to sequentially output a plurality of data voltages separately according to the control signals.

Another implementation manner of the present disclosure relates to a source driver of a display device. According to an embodiment of the present disclosure, the source driver includes a phase generator, a control circuit, and an output circuit. The phase generator is configured to generate a plurality of output clock signals according to an input clock signal. The control circuit includes a plurality of flip-flops, where the flip-flops separately receive the output clock signals so as to generate a plurality of control signals separately according to the output clock signals. The output circuit is electrically connected with the control circuit and is configured to sequentially output a plurality of data voltages separately according to the control signals.

By applying the above embodiment, the output circuit can output data voltages at different times, and the data voltages can be supplied to a pixel circuit substantially corresponding to transmission delays of gate signals.

DETAILED DESCRIPTION

The spirit of the present disclosure will be clearly illustrated below with reference to the accompanying drawings and detailed description, and variations and modifications may be made by those of ordinary skill in the art without departing from the spirit and scope of the present disclosure after attaining an understanding of the embodiments of the present disclosure.

As used herein, the terms such as "first" and "second" and the like do not particularly refer to an order or sequence, and are not intended to limit the present disclosure, but are merely used for the purpose of distinguishing elements or operations that are described in the same technical language.

As used herein, "electrically coupled" may mean that two or more components are in direct physical or electrical contact with each other, or are in indirect physical or electrical contact with each other, while "electrically coupled" may also mean that two or more components cooperate or interact with each other.

As used herein, "comprise", "include", "have" and any variants thereof are open-ended terms and refer to "include, but not limited to".

As used herein, "and/or" means including any or all combinations of the items listed.

As used herein, directional terms such as up, down, left, right, front, or rear merely represent directions in the accompanying drawings. Therefore, the directional terms used are used for purpose of description rather than limiting the present disclosure.

Unless otherwise particularly indicated, the terms, as used herein, generally have the meanings that would be commonly understood by those of ordinary skill in the art. Some terms used to describe the present disclosure are discussed below or elsewhere in this specification to provide additional guidance to those skilled in the art in connection with the description of the present disclosure.

Figure 1:
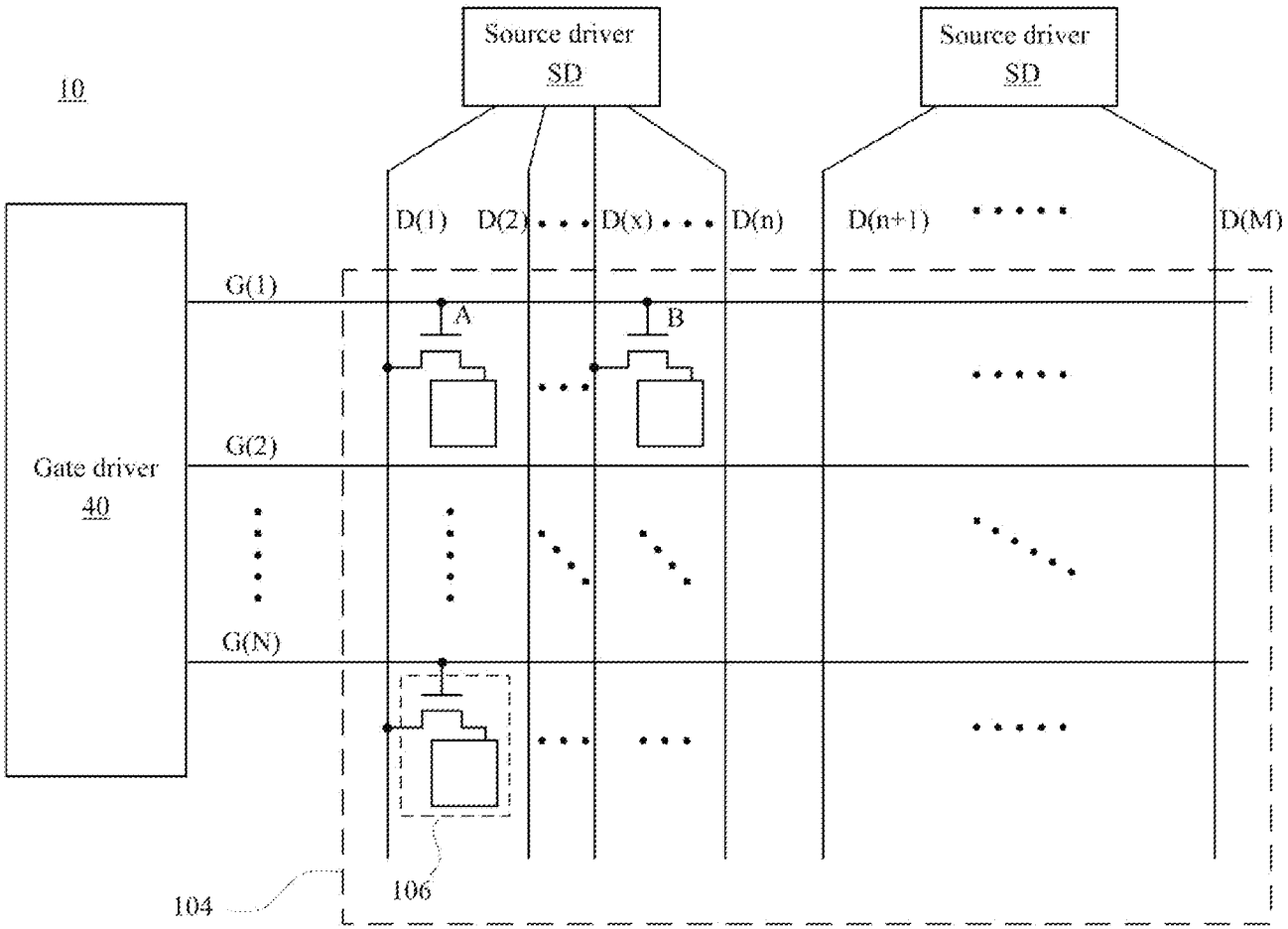
FIG. 1 is a schematic view of a display device according to an embodiment of the present disclosure.

FIG. 1 is a schematic view of a display device 10 according to an embodiment of the present disclosure. In the present embodiment, the display device 10 includes pixel circuits 106, source drive circuits SD and a gate drive circuit 40. The pixel circuits 106 are arranged in a matrix form and are disposed in an active region 104. In the present embodiment, the gate drive circuit 40 supplies gate signals G(1)-G(N) to the pixel circuits 106 column by column so as to turn on switches of the pixel circuits 106 column by column. The source drive circuits SD supply data voltages D(1)-D(M) to the pixel circuits 106 of which the switches are turned on so as to enable the pixel circuits 106 to display corresponding to the data voltages D(1)-D(M), where N and M are natural numbers. It should be noted that in the present embodiment, although two source drive circuits SD are taken as an example, other numbers of source drive circuits SD (such as one or three or more source drive circuits SD) are also within the scope of the present disclosure.

In some practices, due to the transmission delays of gate signals, if the data voltages are simultaneously output, some of the pixel circuits are undercharged so as to affect the image quality. For example, as shown in FIG. 1, the time that the gate signal G(1) is transmitted to a node B is slightly later than the time that the gate signal G(1) is transmitted to a node A, and if the data voltage D(1) and the data voltage D(x) arrive at the pixel circuits 106 at the same time, the time that the data voltage D(x) charges the corresponding pixel circuit 106 is shorter than the time that the data voltage D(1) charges the corresponding pixel circuit 106, which may cause that the pixel circuit 106 corresponding to the data voltage D(x) is undercharged so as to affect the display quality.

In an embodiment of the present disclosure, the source drive circuits SD can separately perform different delays on the data voltages D(1)-D(M) so as to enable the data voltages D(1)-D(M) to arrive at the pixel circuits 106 substantially corresponding to the transmission delays of the gate signals G(1)-G(N). Therefore, the charging operation of the pixel circuits 106 is more accurate, and the image quality is improved.

Figure 2:
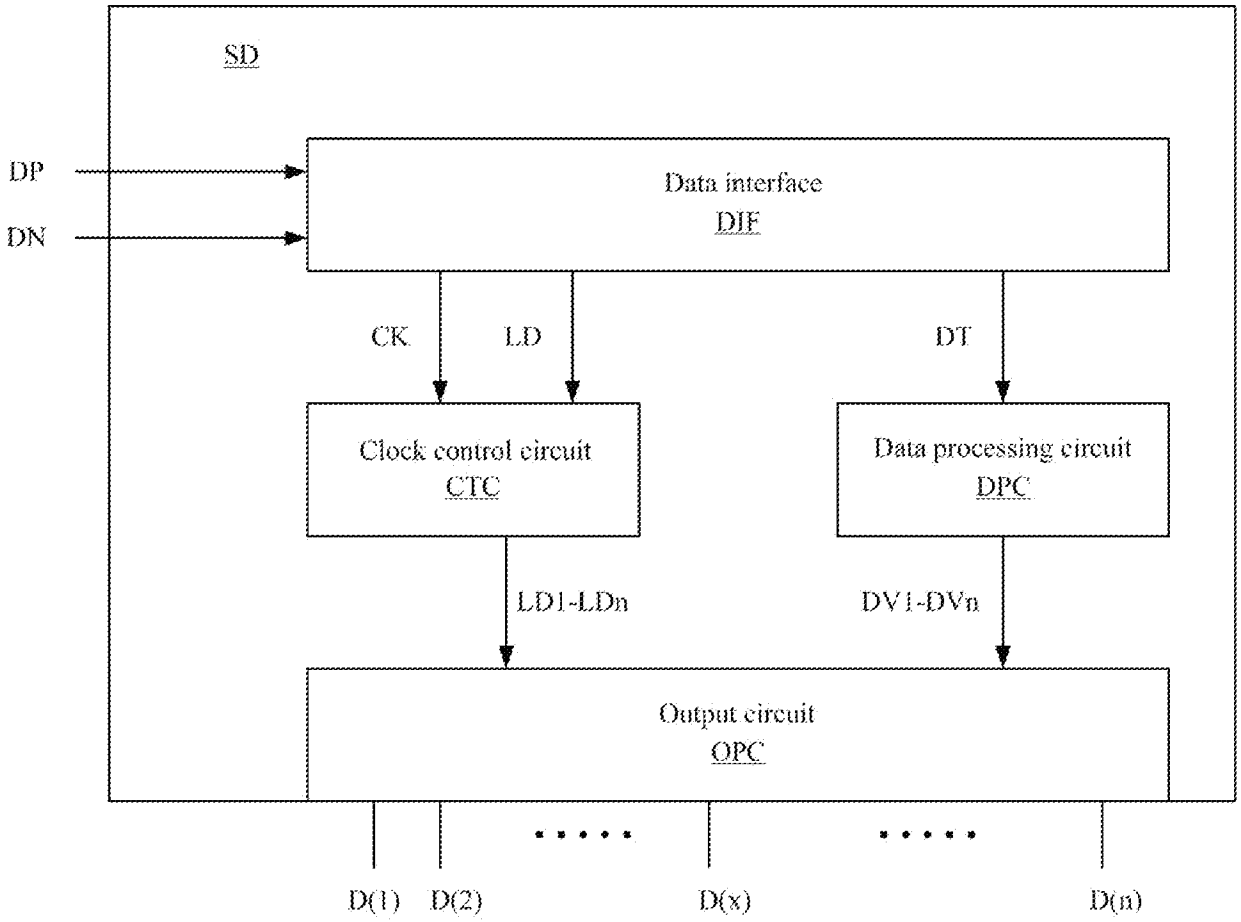
FIG. 2 is a schematic view of a source driver according to an embodiment of the present disclosure.

Refer to FIG. 2. FIG. 2 is a schematic view of a source drive circuit SD according to an embodiment of the present disclosure. It should be noted that although the source drive circuit SD outputting the data voltages D(1)-D(n) is taken as an example, other source drive circuits SD can also have similar structures and functions.

In the present embodiment, the source drive circuit SD is configured to receive display signals DP and DN and generate the data voltages D(1)-D(n) supplied to the pixel circuits 106 according to the display signals DP and DN.

In the present embodiment, the source drive circuit SD includes a data interface DIF, a clock control circuit CTC, a data processing circuit DPC, and an output circuit OPC. In the present embodiment, the data interface DIF is electrically connected with the clock control circuit CTC and the data processing circuit DPC separately, and the clock control circuit CTC and the data processing circuit DPC are electrically connected with the output circuit OPC separately.

In the present embodiment, the data interface DIF is configured to receive the display signals DP and DN and generate a clock signal CK, a latch signal LD and a data signal DT according to the display signals DP and DN. In the present embodiment, the data interface DIF can supply the clock signal CK and the latch signal LD to the clock control circuit CTC and supply the data signal DT to the data processing circuit DPC.

In the present embodiment, the clock control circuit CTC is configured to sequentially supply a plurality of control signals LD1-LDn to the output circuit OPC according to the clock signal CK and the latch signal LD. In an embodiment, the phases of the control signals LD1-LDn are different from each other, but are not limited thereto. In an embodiment, the waveforms of the latch signal LD and the control signals LD1-LDn are identical, but are not limited thereto. In an embodiment, the phases of the latch signal LD and a part of or all of the control signals LD1-LDn are different, but are not limited thereto. In an embodiment, time points that the clock control circuit CTC supplies a plurality of control signals LD1-LDn to the output circuit OPC can be determined corresponding to the transmission delays of the gate signals G(1)-G(N), but are not limited thereto.

In the present embodiment, the data processing circuit DPC is configured to supply data voltages DV1-DVn to the output circuit OPC according to the data signal DT. In an embodiment, the data processing circuit DPC can include, but not limited to, a digital-to-analog converter, a level shifter, and a data latch.

In the present embodiment, the output circuit OPC is configured to sequentially output a plurality of data voltages D(1)-D(n) according to the control signals LD1-LDn. In an embodiment, the output circuit OPC sequentially outputs a plurality of data voltages D(1)-D(n) separately according to the control signals LD1-LDn and the data voltages DV1-DVn. For example, the output circuit OPC outputs the data voltage D(1) according to the control signal LD1 and the data voltage DV1, and outputs the data voltage D(2) according to the control signal LD2 and the data voltage DV2, and so on.

Figure 3:
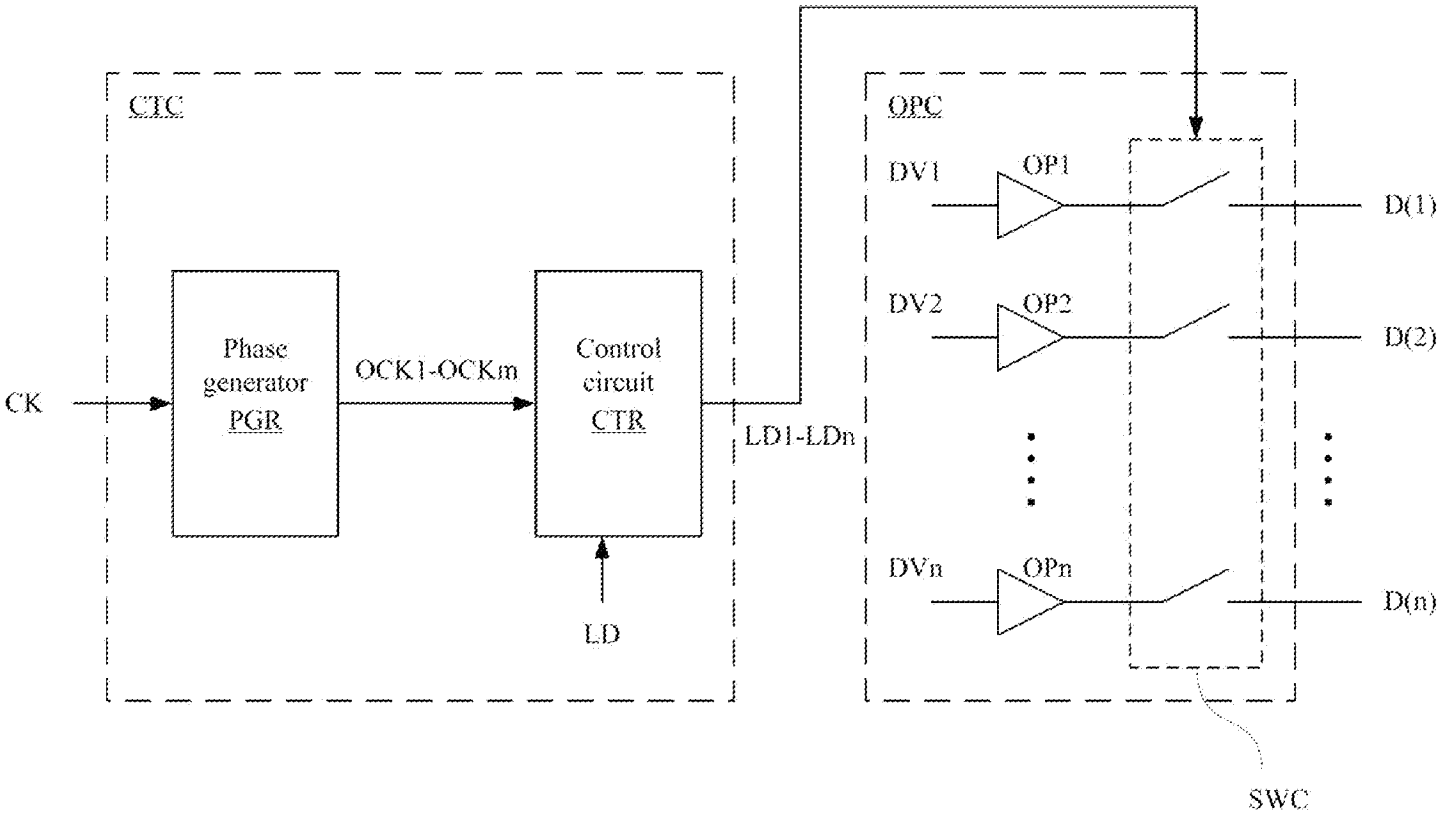
FIG. 3 is a schematic view of a clock control circuit and an output circuit according to an embodiment of the present disclosure.

Referring to FIG. 3, in an embodiment, the clock control circuit CTC includes a phase generator PGR and a control circuit CTR. In an embodiment, the phase generator PGR and the control circuit CTR are electrically connected to each other.

In an embodiment, the phase generator PGR is configured to generate a plurality of output clock signals OCK1-OCKm according to a clock signal CK (hereinafter referred to as an input clock signal CK). In an embodiment, the phases of the output clock signals OCK1-OCKm are different from each other. In an embodiment, the waveforms of the output clock signals OCK1-OCKm are identical. In an embodiment, the clock signals OCK1-OCKm generated by the phase generator PGR can be determined corresponding to the transmission delays of the gate signals G(1)-G(N), but are not limited thereto.

In an embodiment, the control circuit CTR is configured to sequentially generate the plurality of control signals LD1-LDn according to the output clock signals OCK1-OCKm and the latch signal LD. In an embodiment, the control circuit CTR gradually delays the latch signal LD by utilizing the output clock signals OCK1-OCKm so as to sequentially generate the plurality of control signals LD1-LDn. In an embodiment, the number of the output clock signals OCK1-OCKm and the number of the control signals LD1-LDn can be identical or different. For example, the number of the output clock signals OCK1-OCKm can be 8, and the number of the control signals LD1-LDn can be 32. The control circuit CTR can generate control signals LD1, LD9, LD17 and LD25 by utilizing the output clock signal OCK1, and can generate control signals LD2, LD10, LD18 and LD26 by utilizing the output clock signal OCK2, and so on.

In an embodiment, the output circuit OPC includes a plurality of amplifiers OP1-OPn and a switching circuit SWC. The amplifiers OP1-OPn are electrically connected with switches in the switching circuit SWC separately. In an embodiment, the amplifiers OP1-OPn are configured to receive the data voltages DV1-DVn separately. In an embodiment, the amplifiers OP1-OPn are configured to output the data voltages D(1)-D(n) according to the data voltages DV1-DVn by means of the corresponding switches in the switching circuit SWC. In an embodiment, the switches in the switching circuit SWC are configured to be sequentially turned on according to the control signals LD1-LDn so as to sequentially output the data voltages D(1)-D(n) generated by the amplifiers OP1-OPn to the pixel circuits 106.

By means of the above arrangement, the output circuit OPC can output the data voltages D(1)-D(n) at different times to enable the data voltages D(1)-D(n) to be supplied to the pixel circuits 106 substantially corresponding to the transmission delays of the gate signals G(1)-G(N).

Figure 4:
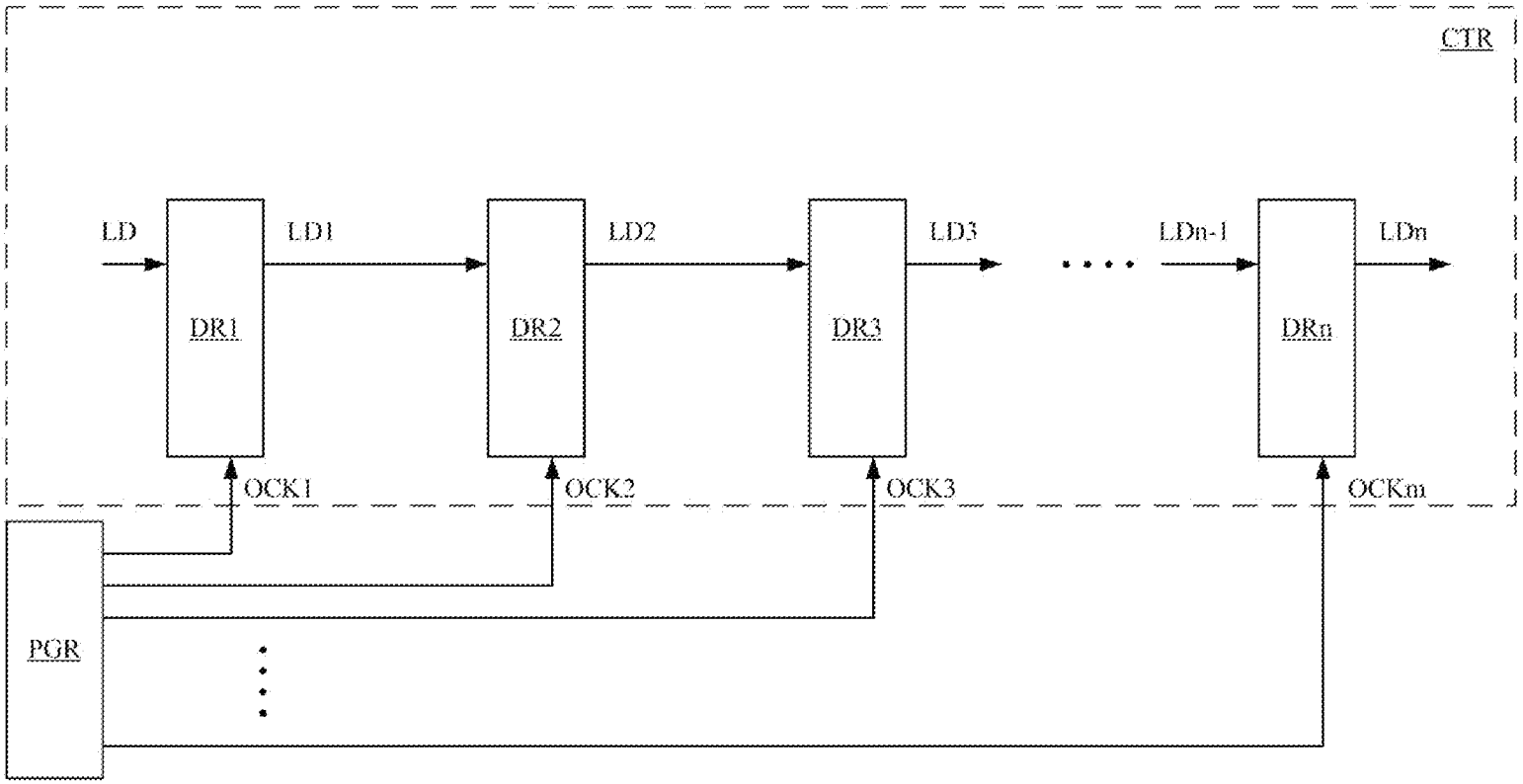
FIG. 4 is a schematic view of a phase generator and a control circuit according to an embodiment of the present disclosure.

FIG. 4 provides further details in an embodiment of the present disclosure, but the present disclosure is not limited thereto. In an embodiment, the control circuit CTR includes a plurality of flip-flops DR1-DRn. In an embodiment, the flip-flops DR1-DRn are electrically connected to each other in series. In an embodiment, the flip-flops DR1-DRn are configured to output the control signals LD1-LDn separately corresponding to the output clock signals OCK1-OCKm. In an embodiment, the flip-flop DR1 is configured to delay the latch signal LD according to the output clock signal OCK1 so as to output the control signal LD1 to the flip-flop DR2, the flip-flop DR2 is configured to delay the control signal LD1 according to the output clock signal OCK2 so as to output the control signal p LD2 to the flip-flop DR3, and the flip-flop DR3 is configured to delay the control signal LD2 according to the output clock signal OCK3 so as to output the control signal LD3 to the next flip-flop, and so on.

It should be noted that in the present embodiment, as an example for explanation, the flip-flop DRn is configured to output the control signal LDn according to the output clock signal OCKm. However, in different embodiments, the flip-flop DRn can also output the control signal LDn according to other clock signals (such as any one of clock signals OCK1 to OCKm-1). In other words, in different embodiments, n may not be a multiple of m.

Figure 5:
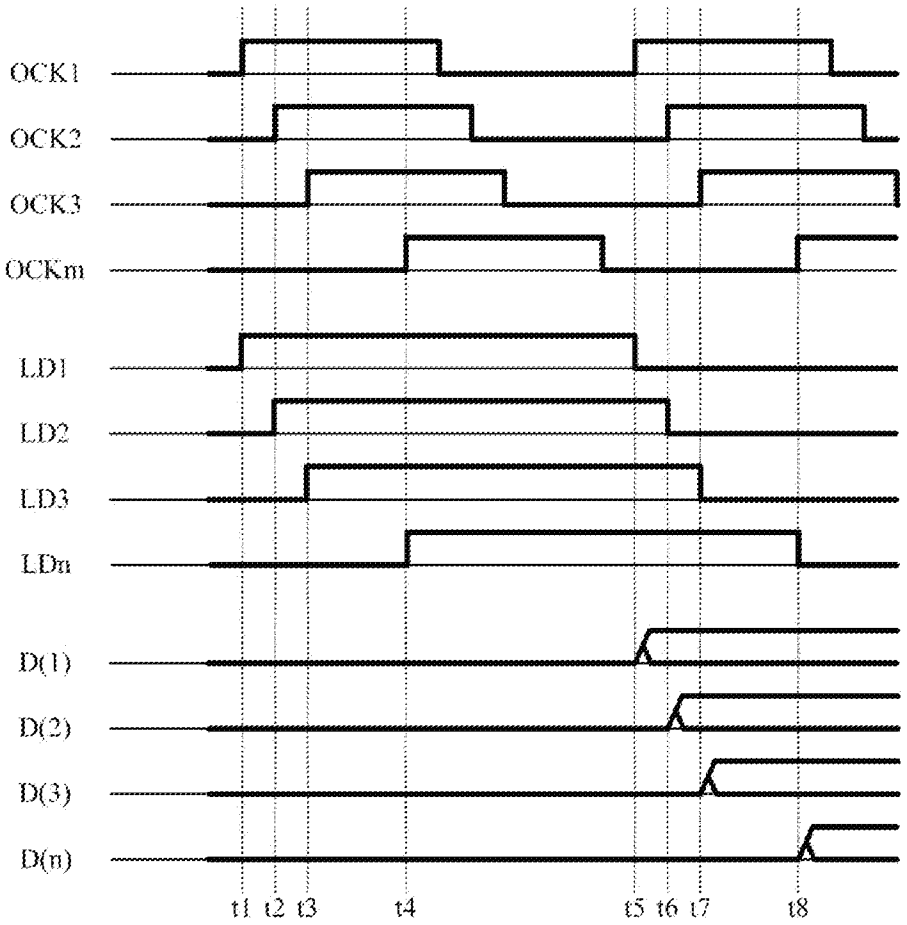
FIG. 5 is a signal waveform view of a source driver according to an embodiment of the present disclosure.

Referring to FIG. 5, at a time point t1, the flip-flop DR1 outputs the control signal LD1 to the flip-flop DR2 according to the output clock signal OCK1. At a time point t2, the flip-flop DR2 outputs the control signal LD2 to the flip-flop DR3 according to the output clock signal OCK2. At a time point t3, the flip-flop DR3 outputs the control signal LD3 to the next flip-flop according to the output clock signal OCK3. At a time point t4, the flip-flop DRn delays the control signal LDn-1 according to the output clock signal OCKm so as to output the control signal LDn.

At a time point t5, a negative edge of the control signal LD1 turns on the switch of the corresponding amplifier OP1 so as to enable the data voltage D(1) to be output. At a time point t6, a negative edge of the control signal LD2 turns on the switch of the corresponding amplifier OP2 so as to enable the data voltage D(2) to be output. At a time point t7, a negative edge of the control signal LD3 turns on the switch of the corresponding amplifier OP3 so as to enable the data voltage D(3) to be output. At a time point t8, a negative edge of the control signal LDn turns on the switch of the corresponding amplifier OPn so as to enable the data voltage D(n) to be output.

By means of the above arrangement, the output circuit OPC can output the data voltages D(1)-D(n) at different times to enable the data voltages D(1)-D(n) to be supplied to the pixel circuits 106 substantially corresponding to the transmission delays of the gate signals G(1)-G(N).

Figure 6:
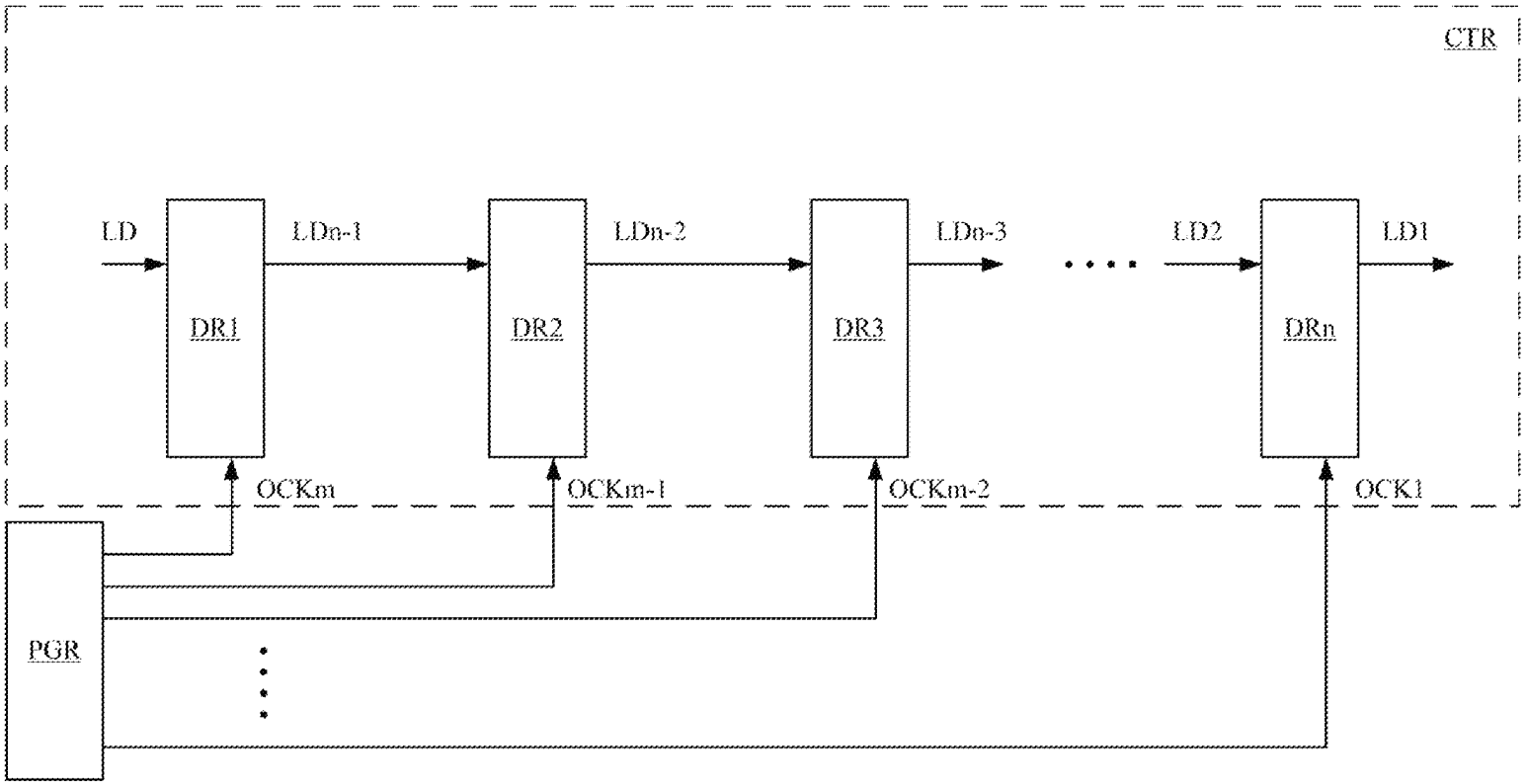
FIG. 6 is a schematic view of a phase generator and a control circuit according to another embodiment of the present disclosure.

FIG. 6 provides details in another embodiment of the present disclosure, but the present disclosure is not limited thereto. In the present embodiment, the control circuit CTR is substantially the same as the corresponding control circuit CTR in FIG. 4, so the same portions are not described herein. In the present embodiment, the control circuit CTR outputs the control signals LD1-LDn in a sequence opposite to that of the corresponding embodiment in FIG. 4 so as to enable the data voltages D(1)-D(n) to be output in the sequence opposite to that of the corresponding embodiment in FIG. 4.

In the present embodiment, the flip-flop DR1 is configured to delay the latch signal LD according to the output clock signal OCKm so as to output the control signal LDm-1 to the flip-flop DR2, the flip-flop DR2 is configured to delay the control signal LDm-1 according to the output clock signal OCKm-1 so as to output the control signal LDm-2 to the flip-flop DR3, and the flip-flop DR3 is configured to delay the control signal LDm-2 according to the output clock signal OCKm-3 so as to output the control signal LDm-3 to the next flip-flop, and so on.

Figure 7:
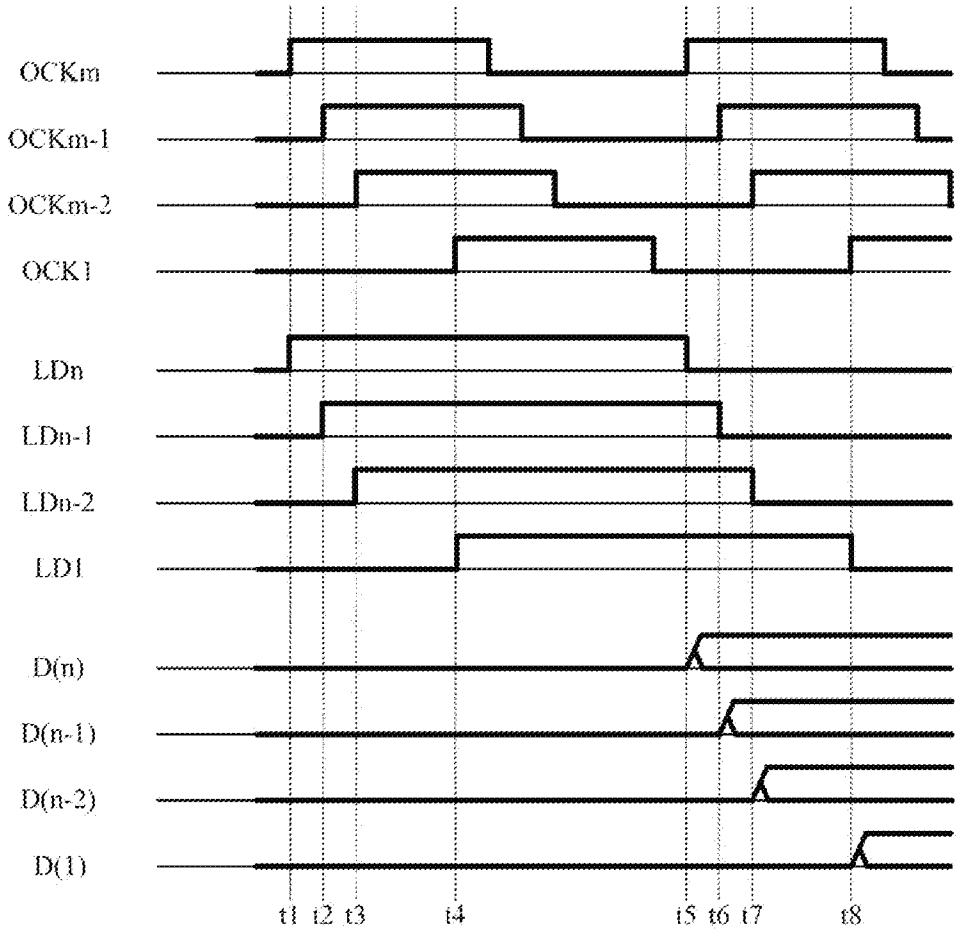
FIG. 7 is a signal waveform view of a source driver according to another embodiment of the present disclosure.

Also referring to FIG. 7, at the time point t1, the flip-flop DR1 outputs the control signal LDn to the flip-flop DR2 according to the output clock signal OCKm. At the time point t2, the flip-flop DR2 outputs the control signal LDn-1 to the flip-flop DR3 according to the output clock signal OCKm-1. At the time point t3, the flip-flop DR3 outputs the control signal LDn-2 to the next flip-flop DR according to the output clock signal OCKm-2. At the time point t4, the flip-flop DRn outputs the control signal LD1 according to the output clock signal OCK1.

At the time point t5, the negative edge of the control signal LDn turns on the switch of the corresponding amplifier OPn so as to enable the data voltage D(n) to be output. At the time point t6, the negative edge of the control signal LDn-1 turns on the switch of the corresponding amplifier OPn-1 so as to enable the data voltage D(n-1) to be output. At the time point t7, the negative edge of the control signal LDn-2 turns on the switch of the corresponding amplifier OPn-2 so as to enable the data voltage D(n-1) to be output. At the time point t8, the negative edge of the control signal LD1 turns on the switch of the corresponding amplifier OP1 so as to enable the data voltage D(1) to be output.

Figure 8:
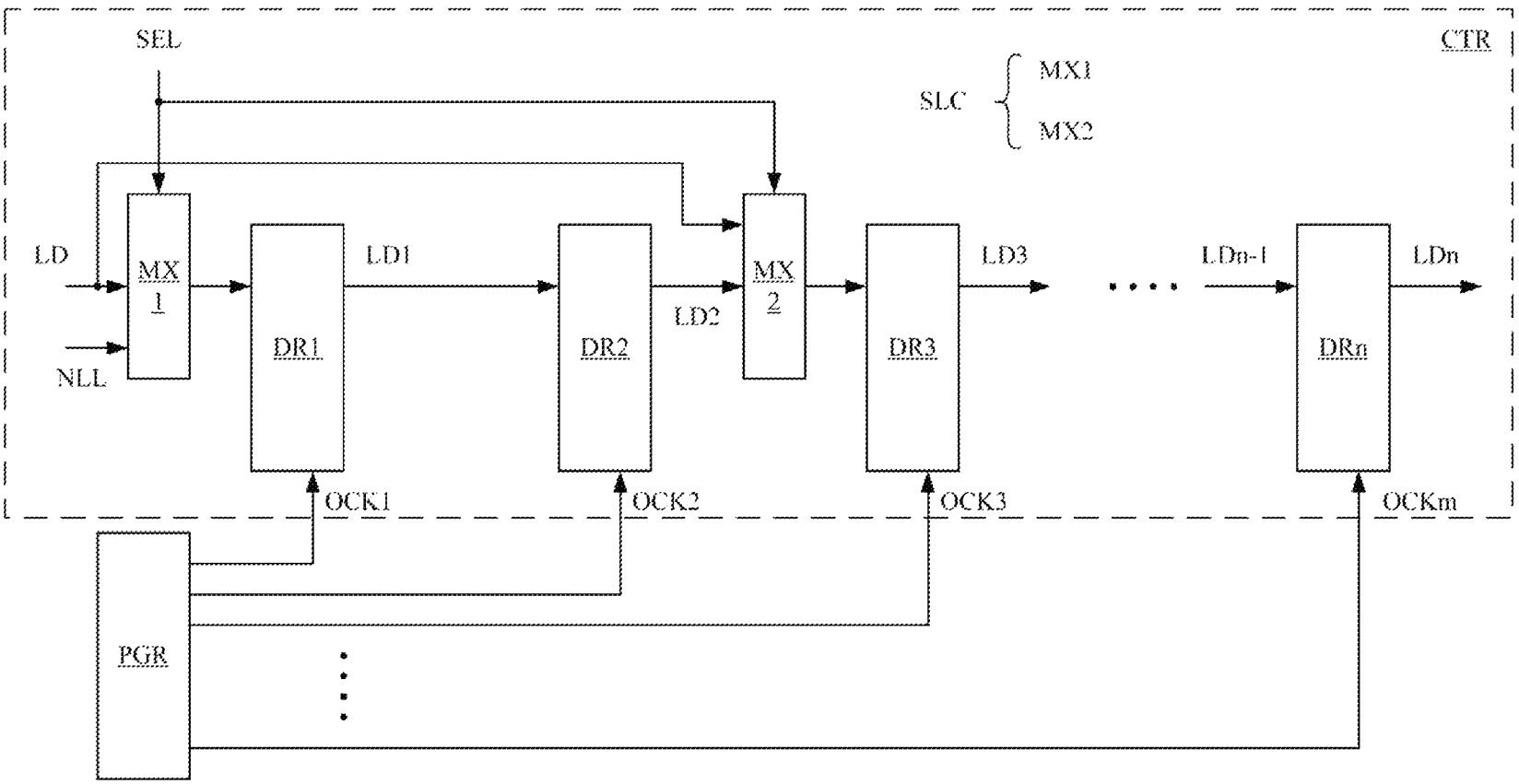
FIG. 8 is a schematic view of a phase generator and a control circuit according to another embodiment of the present disclosure.

FIG. 8 provides details in another embodiment of the present disclosure, but the present disclosure is not limited thereto. In the present embodiment, the control circuit CTR further includes a selection circuit SLC. In the present embodiment, the selection circuit SLC is configured to prevent one or more of the flip-flops DR1-DRn from outputting corresponding portions of the control signals LD1-LDn according to a selection signal SEL. For example, in the corresponding embodiment in FIG. 8, the selection circuit SLC can prevent the flip-flops DR1-DR2 from outputting the corresponding portions of the control signals LD1-LD2 according to the selection signal SEL.

It should be noted that in FIG. 8, as an example for explanation, the selection circuit SLC is applied to a structure similar to that as shown in FIG. 4. However, the selection circuit SLC can also be applied to a structure similar to that as shown in FIG. 6. Therefore, the present disclosure is not limited to the present embodiment.

In an embodiment, the selection circuit SLC includes multiplexers MX1 and MX2. In an embodiment, the multiplexers MX1 and MX2 are electrically connected between the flip-flops DR1-DRn separately and are configured to prevent one or more of the flip-flops DR1-DRn from outputting corresponding portions of the control signals LD1-LDn.

In the present embodiment, a first input terminal of the multiplexer MX1 is configured to receive the latch signal LD, a second input terminal of the multiplexer MX1 is configured to receive the null signal NLL, an output terminal of the multiplexer MX1 is electrically connected with an input terminal of the flip-flop DR1, and a control terminal of the multiplexer MX1 is configured to receive the selection signal SEL. In the present embodiment, the multiplexer MX1 is configured to selectivity output the latch signal LD or the null signal NLL to the input terminal of the flip-flop DR1 according to the selection signal SEL.

In the present embodiment, a first input terminal of the multiplexer MX2 is electrically connected with the output terminal of the flip-flop DR1 and is configured to receive the control signal LD2, a second input terminal of the multiplexer MX2 is configured to receive the latch signal LD, an output terminal of the multiplexer MX2 is electrically connected with an input terminal of the flip-flop DR3, and a control terminal of the multiplexer MX2 is configured to receive the selection signal SEL. In the present embodiment, the multiplexer MX2 is configured to selectivity output the latch signal LD or the control signal LD2 to an input terminal of the flip-flop DR3 according to the selection signal SEL.

In an embodiment, the selection signal SEL can be switched between a first state and a second state so as to enable the multiplexers MX1 and MX2 to output different signals.

When the selection signal SEL is in the first state (such as having a first selection voltage level), the multiplexer MX1 is configured to output the latch signal LD to the input terminal of the flip-flop DR1, and the multiplexer MX2 is configured to output the control signal LD2 to the input terminal of the flip-flop DR3. At this time, the time sequences of the clock signals OCK1-OCKm, the control signals LD1-LDn and the data voltages D(1)-D(n) are substantially the same as those as shown in FIG. 5, and therefore, the descriptions are omitted herein.

When the selection signal SEL is in the second state (such as having a second selection voltage level), the multiplexer MX1 is configured to output the null signal NLL to the input terminal of the flip-flop DR1, and the multiplexer MX2 is configured to output the latch signal LD to the input terminal of the flip-flop DR3.

Figure 9:
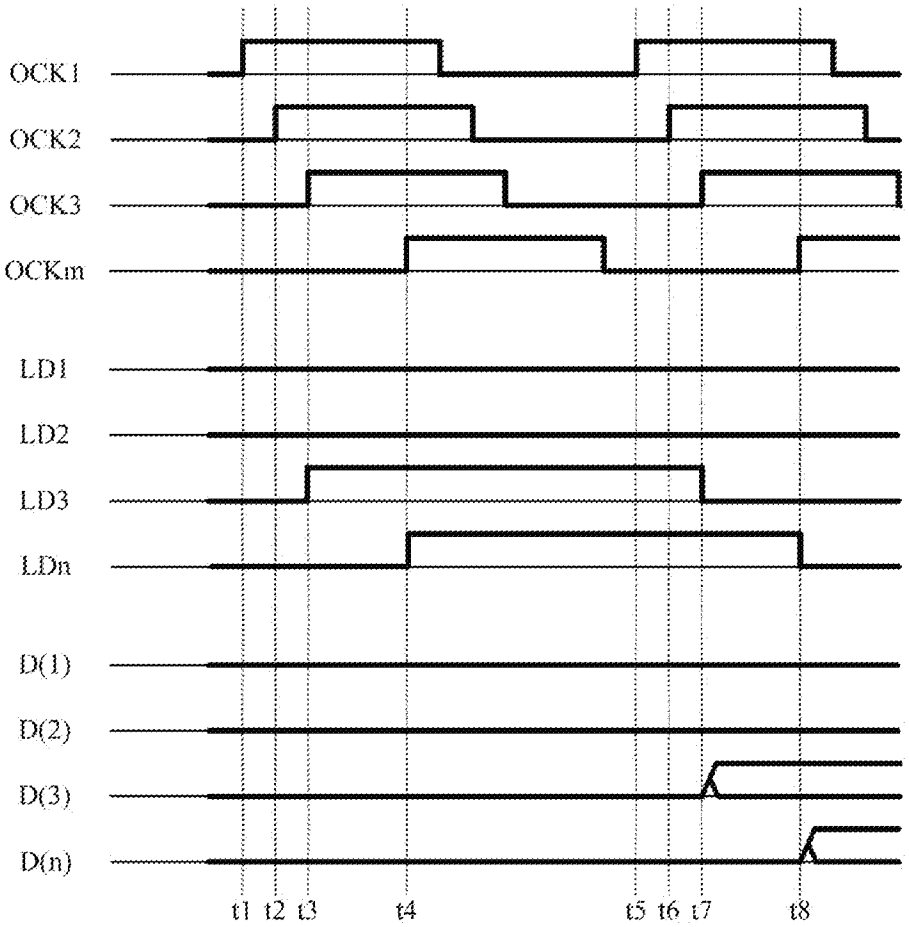
FIG. 9 is a signal waveform view of a source driver according to another embodiment of the present disclosure.

Also referring to FIG. 9, in this state, because the flip-flop DR1 receives the null signal NLL, at the time point t1, the flip-flop DR1 does not output the control signal LD1. Similarly, because the flip-flop DR2 does not receive the control signal LD1 from the flip-flop DR1, at the time point t2, the flip-flop DR2 does not output the control signal LD2.

At the time point t3, the flip-flop DR3 receives the latch signal LD from the multiplexer MX2, so that the flip-flop DR3 outputs the control signal LD3 according to the output clock signal OCK3. At the time point t4, the flip-flop DRn outputs the control signal LDn according to the output clock signal OCKm.

In addition, the control signals LD1 and LD2 are not output, so that at the time points t5 and t6, the switches corresponding to the amplifiers OP1 and OP2 are not turned on, and the data voltages D(1) and D(2) are not output. Relatively, at the time points t7 and t8, the negative edges of the control signals LD3 and LD4 separately turn on the switches corresponding to the amplifiers OP3 and OP4 so as to enable the data voltages D(3) and D(4) to be output.

By applying the above embodiment, the control circuit CTR can change the number of the control signals generated by the control circuit CTR according to the selection signal SEL, and change the number of the data voltages output by the source drive circuit SD.

The present disclosure has been disclosed above by using embodiments; however, the embodiments are not intended to limit the present disclosure, and a person of ordinary skill in the art can make various modifications and improvements without departing from the spirit and scope of the present disclosure; therefore, the protection scope of the present disclosure should be subject to the scope defined by the appended claims.

What is claimed is:

1. A source driver of a display device, comprising:

a phase generator, configured to generate a plurality of output clock signals according to an input clock signal, wherein phases of the output clock signals are different from each other;

a control circuit, electrically connected with the phase generator and configured to sequentially generate a plurality of control signals according to the output clock signals and a latch signal; and an output circuit, electrically connected with the control circuit and configured to sequentially output a plurality of data voltages separately according to the control signals;

wherein the control circuit comprises:

a plurality of flip-flops, electrically connected to each other in series and configured to separately output the control signals corresponding to the output clock signals; and a selection circuit, configured to prevent one or more of the flip-flops from outputting corresponding portions of the control signals according to a selection signal;

wherein the selection circuit comprises:

a first multiplexer, configured to selectively supply a latch signal to an input terminal of one of the flip-flops according to the selection signal; and a second multiplexer, configured to selectively supply the latch signal to an input terminal of another one of the flip-flops according to the selection signal.

2. The source driver according to claim 1, wherein the control circuit is further configured to change the number of the control signals generated by the control circuit according to a selection signal.

3. The source driver according to claim 1, wherein under the condition that the first multiplexer supplies the latch signal to the one of the flip-flops, the second multiplexer does not supply the latch signal to the another one of the flip-flops.

4. The source driver according to claim 1, wherein the first multiplexer is further configured to selectively supply a null signal to the input terminal of the one of the flip-flops according to the selection signal.

5. The source driver according to claim 1, wherein the second multiplexer is further configured to selectively supply one of the control signals to the input terminal of the another one of the flip-flops according to the selection signal.

6. The source driver according to claim 1, wherein under the condition that the selection signal is in a first state, the first multiplexer supplies the latch signal to the input terminal of the one of the flip-flops, and the second multiplexer supplies one of the control signals to the input terminal of the another one of the flip-flops.

7. The source driver according to claim 1, wherein under the condition that the selection signal is in a second state, the first multiplexer supplies a null signal to the input terminal of the one of the flip-flops, and the second multiplexer supplies the latch signal to the input terminal of the another one of the flip-flops.

8. The source driver according to claim 1, wherein the selection circuit comprises:

a first multiplexer; and a second multiplexer, wherein the first multiplexer and the second multiplexer are configured to prevent one or more of the flip-flops which are electrically connected between the first multiplexer and the second multiplexer from outputting corresponding portions of the control signals.

9. The source driver according to claim 8, wherein under the condition that the first multiplexer outputs the latch signal, the second multiplexer outputs the control signal from one of the flip-flops.

10. The source driver according to claim 8, wherein under the condition that the first multiplexer outputs a null signal to one of the flip-flops, the second multiplexer outputs the latch signal.

11. A source driver of a display device, comprising:

a phase generator, configured to generate a plurality of output clock signals according to an input clock signal, wherein phases of the output clock signals are different from each other;

a control circuit, electrically connected with the phase generator and configured to sequentially generate a plurality of control signals according to the output clock signals and a latch signal; and an output circuit, electrically connected with the control circuit and configured to sequentially output a plurality of data voltages separately according to the control signals;

wherein the control circuit gradually delays the latch signal according to the output clock signals so as to sequentially generate a plurality of control signals.

12. A source driver of a display device, comprising:

a phase generator, configured to generate a plurality of output clock signals according to an input clock signal;

a control circuit comprising a plurality of flip-flops, wherein the flip-flops separately receive the output clock signals so as to generate a plurality of control signals separately according to the output clock signals; and an output circuit, electrically connected with the control circuit and configured to sequentially output a plurality of data voltages separately according to the control signals;

wherein the flip-flops are configured to gradually delay a latch signal according to the output clock signals so as to generate the control signals.

13. The source driver according to claim 12, wherein the control circuit further comprises:

a plurality of multiplexers, electrically connected between the flip-flops separately and configured to prevent one or more of the flip-flops from outputting corresponding portions of the control signals.

14. The source driver according to claim 13, wherein the multiplexers comprise:

a first multiplexer, configured to receive a null signal and a latch signal and output one of the null signal and the latch signal according to a selection signal; and a second multiplexer, configured to receive a first control signal in the control signals and the latch signal and output one of the first control signal and the latch signal according to the selection signal.

15. The source driver according to claim 14, wherein under the condition that the first multiplexer outputs the latch signal, the second multiplexer outputs the control signal from one of the flip-flops; and under the condition that the first multiplexer outputs the null signal to one of the flip-flops, the second multiplexer outputs the latch signal.

16. The source driver according to claim 12, wherein the phases of the output clock signals are different from each other, so that the flip-flops sequentially generate the control signals.

* * * * *